US006473366B2

(12) United States Patent
Peng

(10) Patent No.: US 6,473,366 B2
(45) Date of Patent: Oct. 29, 2002

(54) METHOD FOR TIMING A CLOCK

(76) Inventor: Koung-Chung Peng, 2F, No. 50, Lane 437, Section 3, Tong Da Road, Hsinchu City (TW)

( * ) Notice: Subject to any disclaimer, the term of this patent is extended or adjusted under 35 U.S.C. 154(b) by 0 days.

(21) Appl. No.: 09/738,811

(22) Filed: Dec. 15, 2000

(65) Prior Publication Data

US 2002/0075761 A1 Jun. 20, 2002

(51) Int. Cl.[7] ..... G04C 11/02; G04C 9/00
(52) U.S. Cl. ..... 368/47; 368/79; 368/239
(58) Field of Search ..... 368/47, 79, 239

(56) References Cited

U.S. PATENT DOCUMENTS 4,290,131 A * 9/1981 Kume et al. ..... 368/187
4,420,263 A * 12/1983 Besson et al.
4,645,357 A * 2/1987 Allgaier et al. ..... 368/187
5,231,612 A * 7/1993 Allgaier et al. ..... 368/47
5,270,993 A * 12/1993 Besson et al.
5,363,348 A * 11/1994 Damle ..... 368/47
5,898,644 A * 4/1999 Ganter et al. ..... 368/187

* cited by examiner

*Primary Examiner*—Vit Miska
*Assistant Examiner*—Jeanne-Marguerite Goodwin

(57) ABSTRACT

A method for timing a radio clock includes the steps of initiating the photoelectric element to sense the references on the hour hand, the minute hand and the second hand, determining whether a reference that stands for the second hand is detected, stopping the second hand at a zero position when the reference that stands for the second hand is detected, initiating the motors of the hour and the minute hands, revolving the hour and minute hand wheels until a reference mark on the hour hand wheel is detected, stopping the hour hand wheel and the minute hand wheel when the reference mark of the minute hand wheel is detected by the photoelectric element; and synchronizing the hour hand, the minute hand and the second hand with readings of the hour, the minute and the second of a time signal sent from a time station.

6 Claims, 4 Drawing Sheets

(A)

(B)

(PRIOR ART)

( B ) ( PRIOR ART)

METHOD FOR TIMING A CLOCK

BACKGROUND OF THE INVENTION

1. Field of the Invention

The present invention relates to a method for timing a clock, and more particularly to a method having multiple equi-spaced references marked on the hour hand wheel so that a photoelectric element is able to sense these references for timing the hour hand, the minute hand and the second hand respectively in a short period of time.

2. Prior Art Description

A radio clock (R/C) can receive a signal sent from the time station for timing. The conventional ways of timing a clock include a power-on timing, a forcing timing and a periodic timing. The power-on timing is the function when the clock is initiated for the first time by power. The forcing timing is the function initiated by the user. The periodic timing is the function initiated automatically in a predetermined time interval.

With reference to FIG. 1, the current radio clock includes a receiving circuit 12 and a processor 13. The receiving circuit 12 receives a time signal sent from the time station via an antenna 11 and decodes the signal before sending it to the processor 13 for processing. The processor 13 is in charge of the operation of the entire timing. When the time function is initiated, the processor 13 will control the hour, the minute and the second hands back to zero (12 o'clock). Taking FIG. 2 for reference, the control of the hour, the minute and the second hands back to zero normally is completed by a photoelectric element 16. The timing function generally is operated by the photoelectric element 16 by judging a reference 17 marked on the hour hand wheel 18 (or the wheel of the minute hand or the wheel of the second hand). With the reference 17, the photoelectric element 16 is able to tell whether the hour, the minute and the second hands are at the right position. That is, if the photoelectric element 16 senses the reference 17 on the hour hand wheel 18, the hour hand is at the right position (at the numeral of 12 on the R/C).

As for the mechanical clock, the wheel of the second hand is driven by a rotor. Then, a first reduced gear is applied to the second hand to drive the wheel of the minute hand. A second reduced gear is used to drive the wheel of the hour hand. Thus, initiation of the timing function to the clock will take much time to set the hour, minute and the second hands back to zero (12 o'clock). In other words, when the photoelectric element 16 senses the reference 17 on the wheel 18 of the hour hand, the wheel of the second hand will revolve 660 times and the corresponding second hand will also revolve 660 times before the reference 17 is sensed. Because of that, the mechanical radio clock uses two sets of motors to drive the second hand and the minute hand respectively, as shown in FIG. 1. One set of the motor 14 drives the second hand and the other set of the motor 15 drives the minute hand so that the movement of the wheel of the second hand is independent to the wheels of the hour hand and the minute hand. Taking FIG. 2 for reference again, the minute hand wheel 19 drives the hour hand wheel 18 through the reduced gear (not shown). The reference 17 is marked on the hour hand wheel 18. When the photoelectric element 16 senses the reference 17, which means the corresponding hour and minute hands are back to their original positions (12 o'clock). As for the second hand, the same manner is used to see if the second hand is back to the zero position (12 o'clock). Suppose the timing function is initiated at one o'clock (01:00), one revolution of the second hand wheel will allow the photoelectric element 16 to sense the reference marked on the second hand wheel. However, when the reference 17 is sensed by the photoelectric element 16, the minute hand wheel 19 will revolve eleven (11) times. Although this method indeed saves a lot of time in timing when compared with the one described earlier, it still wastes much time.

The present invention provides an improved method for timing a radio clock to overcome the above mentioned shortcomings.

SUMMARY OF THE INVENTION

The primary objective of the invention is to provide an improved method for timing a clock by using multiple equi-spaced references marked on the hour hand wheel so that a photoelectric element is able to sense these references for timing the hour hand, the minute hand and the second hand respectively in a short period of time.

Other objects, advantages and novel features of the invention will become more apparent from the following detailed description when taken in conjunction with the accompanying drawings.

DETAILED DESCRIPTION TO THE PREFERRED EMBODIMENT

Figure 1:
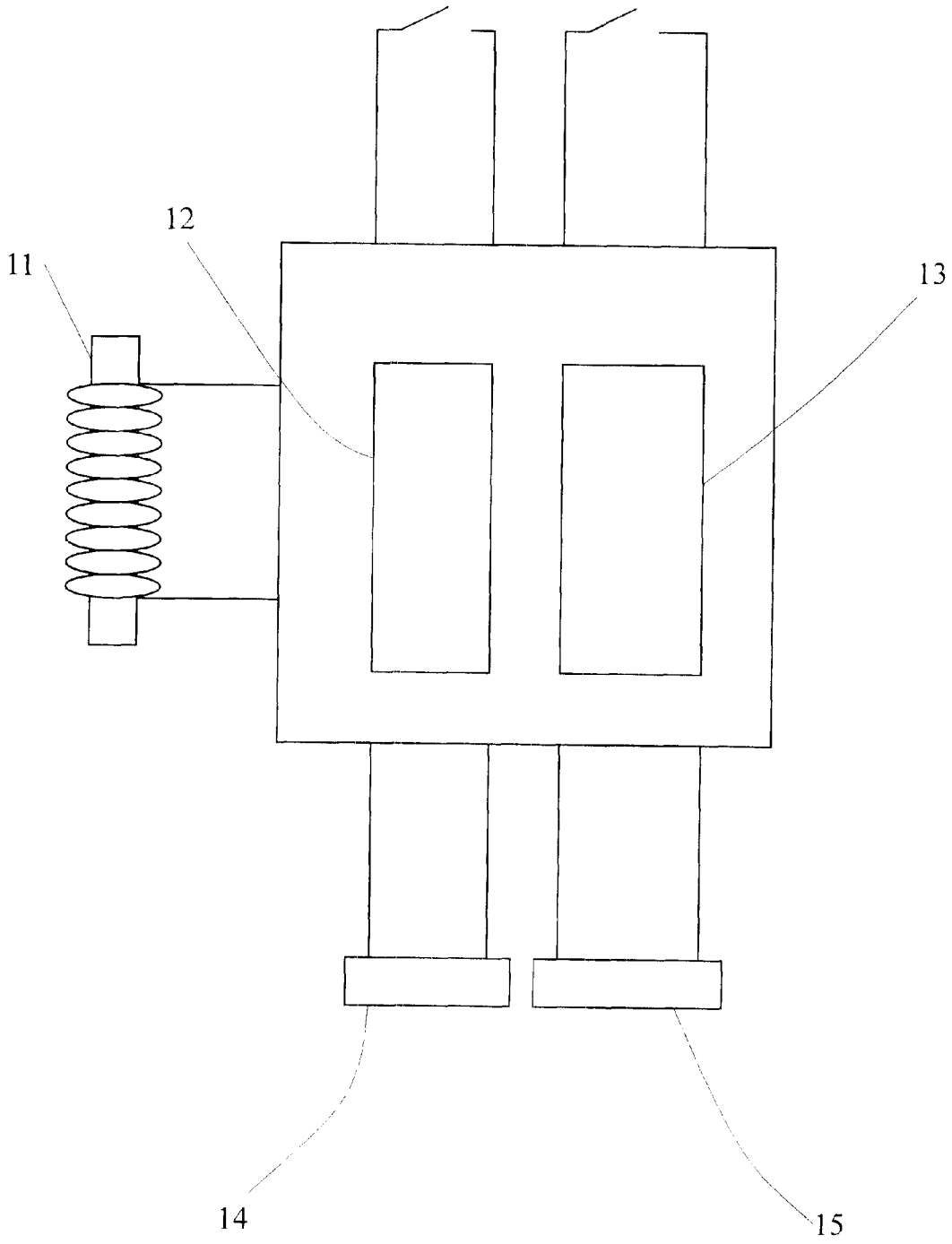
FIG. 1 ( PRIOR ART)
FIG. 1 is a schematic view of the structure of a conventional radio clock.
Figure 2:
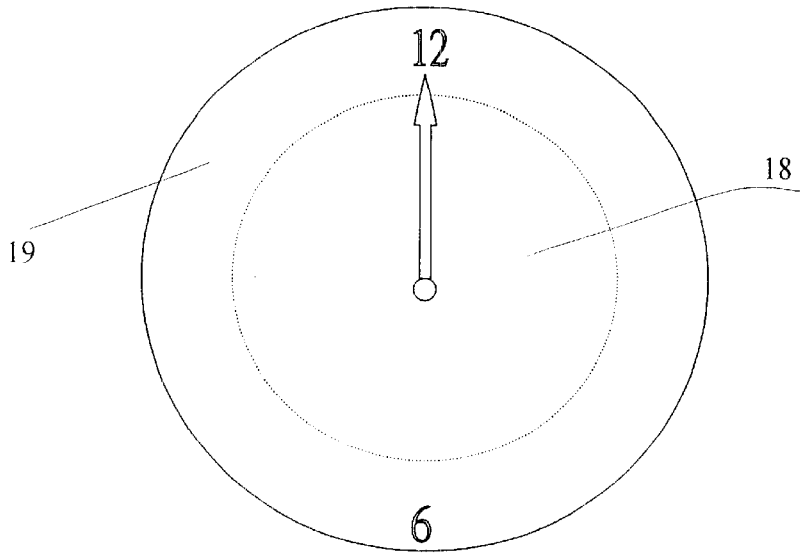
FIG. 2 is a schematic view showing the photoelectric element is used to sense the reference marked on the hour hand wheel to check if the hour, the minute and the second hands are back to their respective positions in the conventional radio clock.
Figure 2:
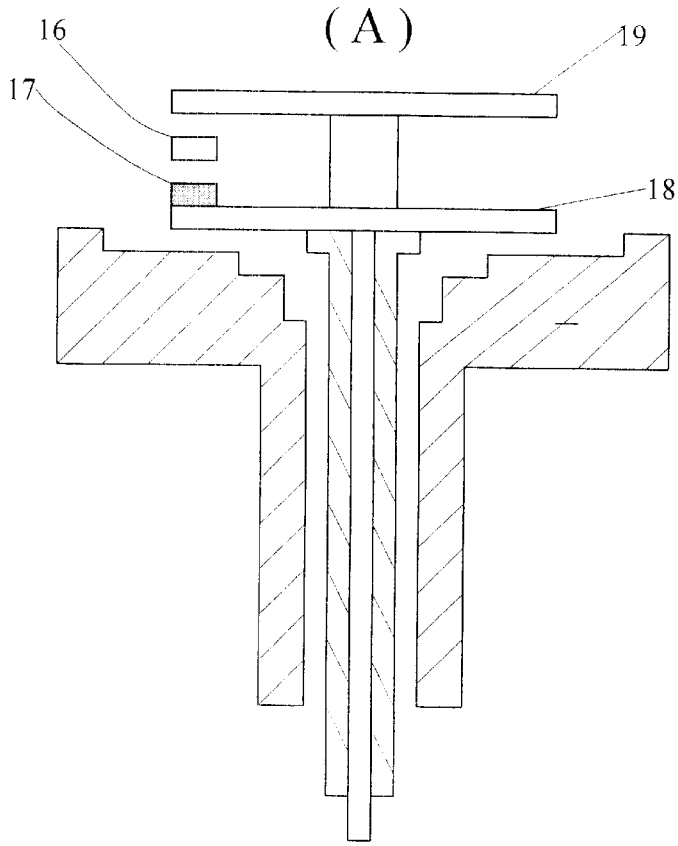
Figure 3:
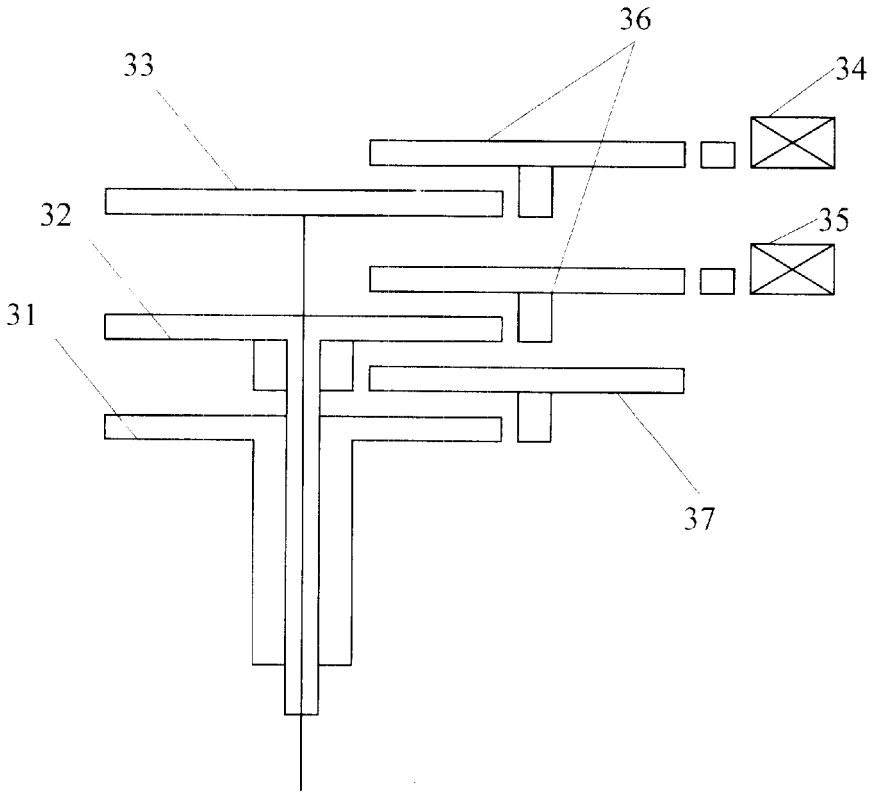
FIG. 3A is a schematic view showing the structure of the radio clock in accordance with the present invention.
FIG. 3B is a schematic view showing a photoelectric element is applied to timing, the hour hand, the minute hand and the second hand.
Figure 3:
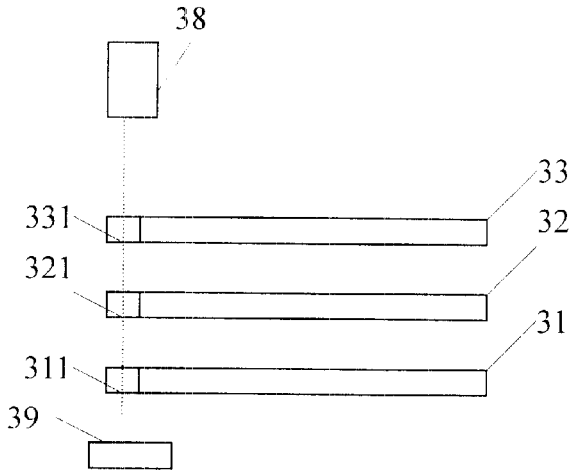

With reference to FIG. 3, the radio clock in accordance with the present invention includes a hour hand wheel 31, a minute hand wheel 32 and a second hand wheel 33. A first motor 34 is applied to drive a first rotor 36 so as to drive the second hand wheel 33. A second motor 35 is applied to drive a second rotor 36' so as to drive the minute hand wheel 32. The minute hand wheel 32 drives the hour hand wheel 31 by means of a reduced gear 37 and a photoelectric element 38 is used to respectively sense references 311, 321 and 331 of the hour hand wheel 31, the minute hand wheel 32 and the second hand wheel 33 to see if the hour hand, the minute hand and the second hand are back to zero position (12 o'clock).

Figure 4:
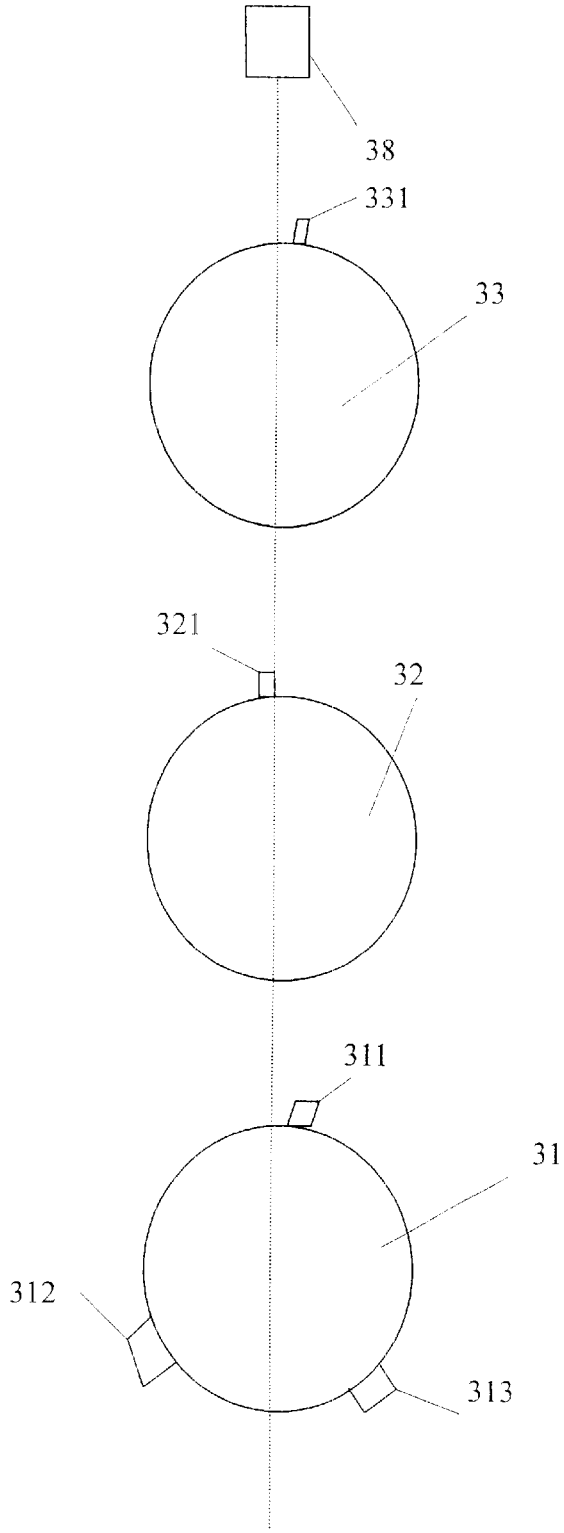
FIG. 4 is a schematic view showing a photoelectric element is applied to timing the hour hand wheel, the minute hand wheel and the second hand wheel respectively.

In order to effectively shorten the time required to set the hour hand, the minute hand and the second hand back to the zero position, multiple references 311, 321 and 313 (three sets of references are shown in this embodiment) are marked on the hour hand motor 31, as shown in FIG. 4 to stand for the hour hand motor 31, the minute hand motor 32 and the second hand motor 33 respectively. That is, when the photoelectric element 38 senses the reference 311, it means that the hour hand is pointing to the numeral 12 of the clock.

When the photoelectric element 38 senses the reference 312, the corresponding hour hand is pointing to the numeral 4 of the clock and when the photoelectric element 38 senses the reference 313, the corresponding hour hand is pointing to the numeral 8 of the clock. Sensing these references 311, 312 and 313 respectively, the photoelectric element 38 is able to tell what is the exact time.

For example, the photoelectric element 38 has a receiver 39, as shown in FIG. 3B, and the photoelectric element 38 sends a signal. When the receiver 39 receives the signal, the photoelectric element 38 will maintain a level of voltage (H). If the signal is blocked from the receiver 39, the photoelectric element 38 will remain another level of voltage (L). Thus, by means of different blocking time to the signal, it is able to know which one of the references is being sensed. Therefore, at most four (4) revolutions of the minute hand wheel, the timing to the hour hand, the minute hand and the second hand is completed.

Taking one practical embodiment for example, suppose the timing function is initiated at one o'clock, the processor starts detecting whether the references are sensed by the photoelectric element 38. If not, the second hand starts to revolve and when the second hand revolves one circle (if the second hand starts from 12) and the photoelectric element senses the reference, the processor stops the revolution of the second hand and maintains the second hand at the zero position (12). When the minute hand revolves three circles, the references 312 on the hour hand is sensed by the photoelectric element 38. The processor stops the revolution of the minute hand and maintains the minute hand at the zero position (12) and the hour hand at the position of 4. Then, the minute the processor receives the time signal from the time station, the processor starts the revolution of the second hand to synchronize the movement of the second hand of the clock and the reading of the second from the time signal. Meanwhile, the processor controls the motor to move the hour hand and the minute hand to synchronize the readings of the hour and minute of the time signal to complete the timing process. Thereafter, the clock runs like a normal clock.

It is concluded that when the timing function is initiated, the minute hand revolves at most four circles (if the initiation time is 12, 8 or 4 o'clock) and the timing process is completed, which reduces a great deal of time when compared with the current timing process.

Because the photoelectric element 38 is fixed, when the photoelectric element 38 senses the reference 331 of the second hand wheel 33, the second hand wheel 33 will continue to revolve for several seconds to allow the photoelectric element 38 to continue to detect other references 311, 321. Thereafter, minute hand motor starts to drive the minute hand wheel to allow the photoelectric element to detect the minute hand reference 321. With the gaps between each of the references, when the photoelectric element does detect the minute hand reference 321, the timing process to the clock is thus completed. Therefore, the invention uses only one photoelectric element to complete the timing process, which is far more efficient and economic when compared with the conventional two sets of photoelectric elements.

In short, the timing process in accordance with the present invention includes the steps of:

Initiating the photoelectric element to sense the references on the hour hand, minute hand and second hand;

Determining whether a reference that stands for the second hand is detected;

Stopping the second hand shortly after the reference that stands for the second hand is detected;

Revolving the hour and minute hand wheels until a reference mark on the hour hand wheel is detected;

Stopping the hour hand wheel and the minute hand wheel when the reference of the minute hand is detected by the photoelectric element; and Synchronizing the hour hand, the minute hand and the second hand with the readings of the hour, the minute and the second of the time signal sent from a time station.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for timing a clock, comprising the steps of:

preparing a reference mark on a second hand wheel;

preparing a reference mark on a minute hand wheel;

preparing a plurality of reference marks on an hour hand wheel;

using a photoelectric element to detect said reference marks;

stopping said second hand wheel shortly after the reference mark on said second hand wheel is detected;

revolving said minute hand wheel and said hour hand wheel;

detecting reference marks on said hour hand wheel and said minute hand wheel; and stopping said minute hand wheel and said hour hand wheel after one of said plurality of reference marks on said hour hand wheel is first detected and then the reference mark on said minute hand wheel is detected;

wherein each of said reference marks on said second hand wheel, said minute hand wheel and said hour hand wheel blocks said photoelectric element a unique period of time, and said method determines which reference mark is detected by means of said unique period of time.

2. The method of timing a clock as claimed in claim 1, wherein three reference marks are equally spaced around said hour hand wheel.

3. The method of timing a clock as claimed in claim 1, wherein a first motor drives said second hand wheel, a second motor drives said minute hand wheel, and a reduced gear coupled to said second motor drives said hour hand wheel.

4. A method for timing a clock, comprising the steps of:

preparing a reference mark on a second hand wheel;

preparing a reference mark on a minute hand wheel;

preparing a plurality of reference marks on an hour hand wheel;

using a photoelectric element to detect said reference marks;

determining if the reference mark of said second hand wheel is detected;

stopping said second hand wheel shortly after the reference mark on said second hand wheel is detected;

revolving said minute hand wheel and said hour hand wheel;

detecting a reference mark on said hour hand wheel;

determining which reference mark on said hour hand wheel is detected;

detecting the reference mark on said minute hand wheel;

stopping said minute hand wheel and said hour hand wheel after the reference mark on said minute hand wheel is detected; and synchronizing said second hand wheel, said minute hand wheel and said hour hand wheel according to a time signal sent from a time station;

wherein each of said reference marks on said second hand wheel, said minute hand wheel and said hour hand wheel blocks said photoelectric element a unique period of time, and said method determines which reference mark is detected by means of said unique period of time.

5. The method of timing a clock as claimed in claim 4, wherein three reference marks are equally spaced around said hour hand wheel.

6. The method of timing a clock as claimed in claim 4, wherein a first motor drives said second hand wheel, a second motor drives said minute hand wheel, and a reduced gear coupled to said second motor drives said hour hand wheel.

* * * * *